US005314330A

United States Patent [19]

Orbeck

[11] Patent Number: 5,314,330

[45] Date of Patent: May 24, 1994

[54] WALKING HEARTH FURNACE

[75] Inventor: Gary A. Orbeck, Windham, N.H.

[73] Assignee: BTU International, No. Billerica, Mass.

[21] Appl. No.: 955,295

[22] Filed: Oct. 1, 1992

[51] Int. Cl.[5] ..... F27B 9/14

[52] U.S. Cl. ..... 432/128; 198/774.3; 198/776; 432/124

[58] Field of Search ..... 432/121, 124, 122, 126, 432/128; 198/776, 774.3

[56] References Cited

U.S. PATENT DOCUMENTS

| | | | |
|---|---|---|---|
| 3,567,195 | 3/1971 | Kakuta et al. | 263/6 |
| 3,633,885 | 1/1972 | Beck | 263/6 |
| 3,664,649 | 5/1972 | Brockmann | 432/122 |
| 3,887,064 | 6/1975 | Brockmann | 198/219 |
| 4,116,619 | 9/1978 | Beck . | |
| 4,330,262 | 5/1982 | Kranzl et al. | 432/122 |
| 4,585,411 | 4/1986 | Bocci et al. | 432/122 |
| 4,723,909 | 2/1988 | Rouvet | 432/124 |
| 4,741,695 | 5/1988 | Ushijima | 432/121 |
| 4,919,254 | 4/1990 | Briemont | 198/751 |

*Primary Examiner*—Henry C. Yuen
*Attorney, Agent, or Firm*—Weingarten, Schurgin, Gagnebin & Hayes

[57] ABSTRACT

A furnace is provided for continuous high-temperature heat processing in which a work product is conveyed through a furnace muffle by rectilinear beam motion. An inner and an outer beam are equipped with interleaved rods which are used to alternately lift the work product and advance it through the muffle. A continuous cycle of sequentially raising and advancing the rods attached to one beam, while lowering and retracting the rods of the other beam causes stepwise movement of the work product through the furnace. At no point in the cycle does the work product, rods, or beams make contact with the muffle, nor do the interleaved rods touch each other. The result is frictionless conveyance of the work product through the muffle which virtually eliminates particle generation.

17 Claims, 5 Drawing Sheets

WALKING HEARTH FURNACE

FIELD OF THE INVENTION

This invention relates to furnaces, and more particularly to a walking hearth conveyor system for efficient transport of a work product through a high-temperature precision furnace.

BACKGROUND OF THE INVENTION

In the heat processing of materials, a work product is usually conveyed through an elongated furnace which can be divided into respective zones, each of which may have its own temperature and gaseous environment. The work product is often conveyed through the furnace by means of a woven metal belt which is moved along the furnace hearth. At elevated temperatures, generally above 1,110° C. such as required for the firing of ferrites and titanites and for the sintering of powder metals and nuclear fuel elements, such metal conveyor belts cannot be employed since the metal will soften or melt at these elevated temperatures. In addition, even at temperatures at which the metal retains its structural integrity, such belts are often a source of particle contamination.

In order to accomplish heat processing at temperatures at which metal conveyor belts are unusable, furnaces have utilized push-rod systems in which a row of product carriers are conveyed through a furnace by means of a reciprocating push rod located at the entrance end of the furnace. The product carriers in such pusher systems must be sufficiently strong to transmit the compressional force applied by the push rod, resulting in a thermally massive carrier sensitive to thermal shock, and of sufficient mass to require a considerable heating and cooling period. Additionally, in such push-rod systems, the product carriers are usually in sliding contact with the muffle hearth, giving rise to abrasion which can cause contamination and consequent degradation of the furnace environment.

To overcome the limitations of push-rod conveyor systems, furnaces have been developed which include a furnace hearth movable with cyclic vertical and horizontal motion to transport product carriers supported thereon in step-wise fashion through the furnace. The movable hearth is usually supported for vertical and horizontal motion by respective pluralities of hydraulic cylinders disposed below the furnace chamber to provide lifting and lowering motion and at each end of the furnace for providing lateral movement of the hearth. These driving elements must be operated in a timed sequential manner to provide intended conveyor motion, and in practice, sequential operation of the plurality of driving elements is difficult to maintain. As a result, precise and consistent transport of a work product through a furnace is not easily achieved and the accuracy of the thermal processing can consequently be impaired. A synchronous operation of the plurality of driving elements can also cause bending moments to be applied to the furnace hearth, which can result in damage to the hearth. In addition, the driving elements below the furnace can be damaged by the high furnace temperature and are not easily accessible for maintenance.

SUMMARY OF THE INVENTION

In surmounting the foregoing disadvantages, the present invention provides a walking hearth furnace for transporting a work piece through a heated chamber in a rectilinear manner. The invention minimizes particle generation generated by abrasion via a substantially frictionless transport mechanism whose elements are easily synchronized. The transport mechanism, which may be automated, is capable of conveying massive work pieces significant distances through a furnace muffle employing a variety of atmospheric and thermal control devices. Additional benefits of the invention are its thermal efficiency and responsiveness.

In a first embodiment, a furnace muffle for containing heat has an entry and an exit opening traversed by a first and a second support surface. The support surfaces alternately advance a work product placed thereon from the entry to the exit opening in a linear manner without sliding the work product.

In a second embodiment, a furnace muffle for containing heat has an entry and an exit opening through which two interleaved groups of parallel rods are passed. Each group of rods forms a movable support surface for transporting a work product through the muffle from the entry to the exit in a rectilinear manner. Support structures associated with each group of rods are responsive to vertical and horizontal displacement devices. The vertical displacement device alternately isolates each group of rods to form a hearth associated with each group of rods. The horizontal displacement device then advances the hearth with the work product placed thereon horizontally through the muffle.

In yet another embodiment, a furnace muffle for containing heat has an entry and an exit opening through which two groups of rods are passed. The ends of the rods of each group are anchored to mounting platforms on upright end portions of support beams associated with each group of rods. The nested support beams are each balanced on two bogies. The bogies are configured so that by tilting the bogies in unison in one direction, one group of rods is raised to form a hearth and the other group is lowered. When the bogies are tilted in the opposite direction, the raised rods forming the hearth for the work product are lowered and the other group of rods is raised to take its place as the hearth. The bogies are furnished with wheels configured to allow each of the beams to be independently rolled along their longitudinal axis. Rotating a first crankshaft coupled to each of the two beams causes the beams to move reciprocally along the longitudinal axis; and rotating a second crankshaft coupled to each of the bogies causes the bogies to tilt in unison to move the beams vertically in a reciprocal manner. When vertical and horizontal beam movements are properly coordinated, the work product is conveyed in an incremental manner through the furnace in a rectilinear manner.

DESCRIPTION OF THE DRAWINGS

The invention will be more fully understood from the following detailed description taken in conjunction with the accompanying drawings in which.

DETAILED DESCRIPTION OF THE INVENTION

Figure 1:
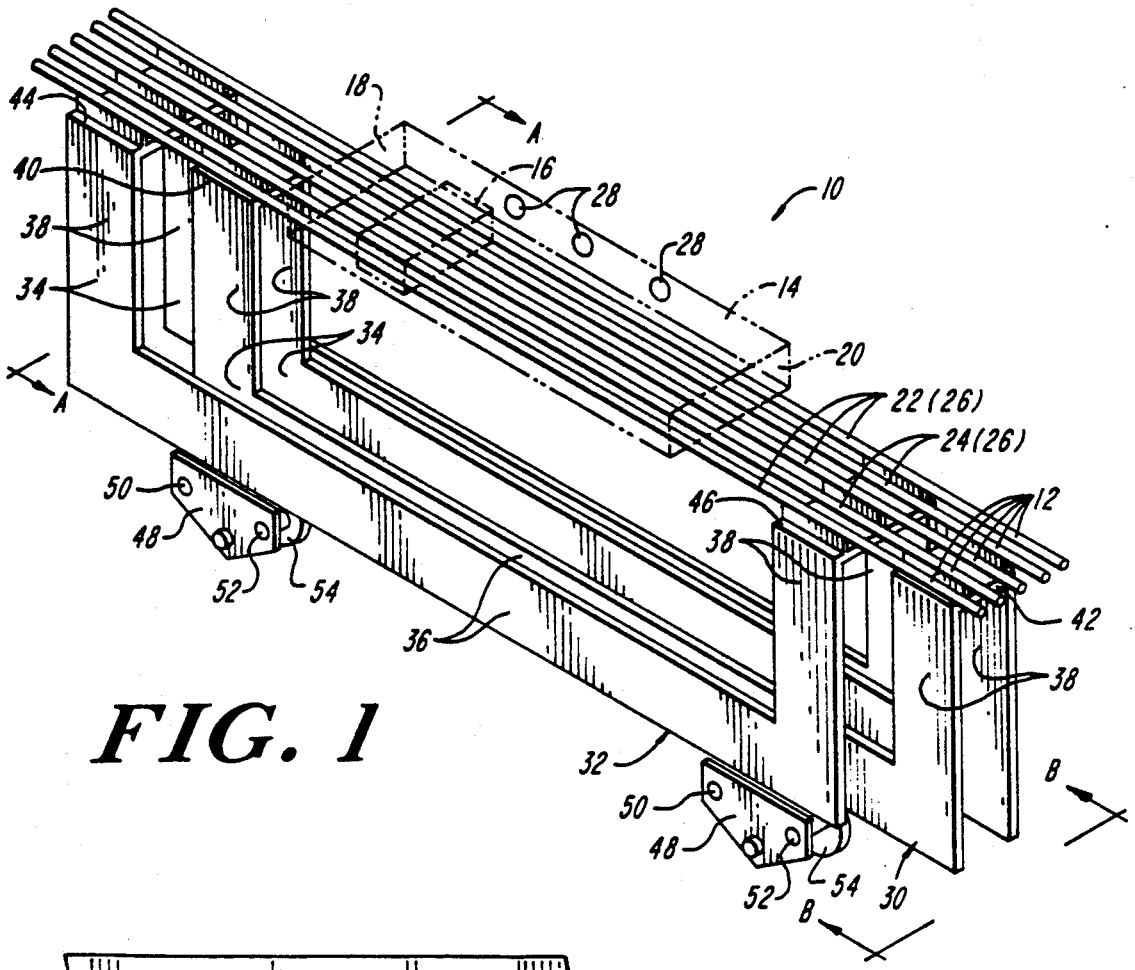
FIG. 1 is a perspective view of a walking hearth furnace of the invention.

Referring to FIG. 1, a continuous process walking hearth furnace 10 is shown. Five rods 12 horizontally traverse the longitudinal axis of a furnace muffle 14, where a work product 16 is heated, from an entry aperture 18 to an exit aperture 20 in the muffle 14. The rods 12 are divided into a first group 22 and a second group 24, wherein the rods 12 of each group are arranged in parallel, in an interleaved or alternating configuration, so that every other rod 12 is a member of the same group. The rods 12 are equally spaced and cover substantially the entire width of the muffle 14. The spacing between the rods 12 is sufficient to permit circulation of furnace gases through and around the rods 12, and to prevent particle generation resulting from frictional contact or abrasion between adjacent rods 12. The upper surface of the rods 12 forms a movable support surface or hearth 26 for the work product 16 as it is transported through the furnace muffle 14. Raising one group of rods or lowering the other group, with respect to a given horizontal plane, provides a support surface or hearth 26 of either two or three rods 12 in an embodiment having five rods 12, both of which are of sufficient size and strength to independently support the work product 16. The shape and number of rods 12 may be varied as a function of their strength and width in relation to the weight or characteristics of the work product 16, as a function of the width of the muffle 14, or as required for proper exposure to a particular heat source 28.

In an exemplary embodiment, the muffle 14 is suitable for use in a hydrogen or another gaseous explosive atmosphere with an operating temperature of 800° C. Metal is used to form the muffle 14 because quartz or ceramic muffles are more likely to crack or break containment than metal in this environment. For a muffle 14 that is eighteen feet long and nine inches wide, the rods 12 are one-half inch in diameter, spaced one and one-half inches apart, and support a work product load of five pounds per foot. Limitations on muffle length, work product weight and size, and processing temperature will affect the characteristics of the walking hearth furnace 10 depending on the specific design requirements.

In order for the rods 12 to traverse the interior of the muffle 14 without touching any surface therein, the rods 12 are supported only at the rod ends protruding from the muffle 14. In an embodiment of the walking hearth furnace 10 having an eighteen-foot muffle 14, the rods 12 are twenty or more feet long, resulting in unsupported rod portions at least eighteen-feet in length. The unsupported portion of each rod 12 is subjected to a considerable load from both its own weight and that of the work product 16 placed thereon, especially at the center of the unsupported portion. However, for the walking hearth furnace 10 to function properly, the unsupported portion of each rod 12 must not flex or bend more than a nominal amount.

To obtain the rigidity the rods 12 must have for proper furnace 10 operation, the rods 12 are preloaded to a high tensile stress. By applying a tensile preload, the rods 12 are able to carry a heavier work product 16 through the muffle 14 of a given length than conventionally designed, simply supported rods 12. If lightweight work products 16 will be processed, the preloaded rods 12 are sufficiently rigid to function with even longer muffles 14.

The high tensile preload on the rods 12, and the high stress placed on them by the weight of the work product 16, necessitates that the rods 12 be attached to substantial support structures such as the inner beam 30 and outer beam 32 depicted in FIG. 1. Each of the beams has two identical side members 34 comprising a central body 36 that passes below the muffle 14, with an upright member 38 at either end of the central body 36. The upright members 38 of the side members 34 of the inner beam 30 are joined together on the entry aperture 18 end of muffle 14 by an inner beam entrance side rod attachment platform 40, and joined together on the exit aperture 20 end by an inner beam exit side rod attachment platform 42. The upright members 38 of the outer beam 32 are attached in a similar manner to an outer beam entrance side rod attachment platform 44 and an outer beam exit side rod attachment platform 46. The platforms 44 and 46 of the outer beam 32 are wider than the platforms 40 and 42 of the inner beam 30, thus allowing the inner beam 30 to be positioned within the boundaries created by the side members 34 of the outer beam 32. Both the inner and outer beams 30 and 32, respectively, are of identical dimensions except for the spacing of the side members 34, so that when the bottom of each central body 36 rests on a common surface, both groups of rods 22 and 24 are aligned in the same horizontal plane, thereby forming a single level surface or hearth 26.

In order to cause either the first group of rods 22 or the second group of rods 24 to serve as the operative hearth 26, a vertical displacement device is needed to cause the inner and the outer beams 30 and 32 that support the groups of rods 22 and 24 to move up and down in an inter-related manner. When properly coordinated, reciprocal vertical movement of the groups of rods 22 and 24 causes the group of rods forming the hearth 26 to be smoothly replaced with the other group of rods in order to maintain the hearth elevation at a constant horizontal plane within the muffle 14. The smooth passage of the work product 16 from one support surface or hearth 26 to the next is accomplished without rubbing, scraping, or sliding along the supported surface of the work product 16, thereby virtually eliminating particle generation from abrasion.

In the embodiment of FIG. 1, the vertical displacement device includes a pair of bogies 48. Each bogie 48 has two axles 50, 52 and each axle 50, 52 has freely rotating wheels 54 mounted thereon. Balancing the mass of the beams 30, 32 between the bogies 48 longitudinally stabilizes the beams. Lateral stabilization of the beams 30, 32 may be enhanced by incorporating tracks or grooves along the lower or contact surface of the central bodies 36 to mate with appropriately dimensioned wheels 54. Alternatively, the wheels 54 may have channels for central bodies 36 to travel through.

Figure 2A:
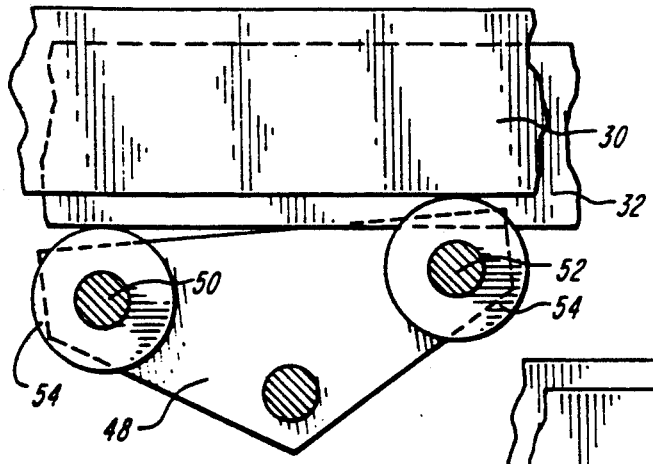
FIGS. 2A and 2B are sectional side views of one of the bogies for the device of FIG. 1, depicting beam movement as the bogie is rotated.
Figure 2B:
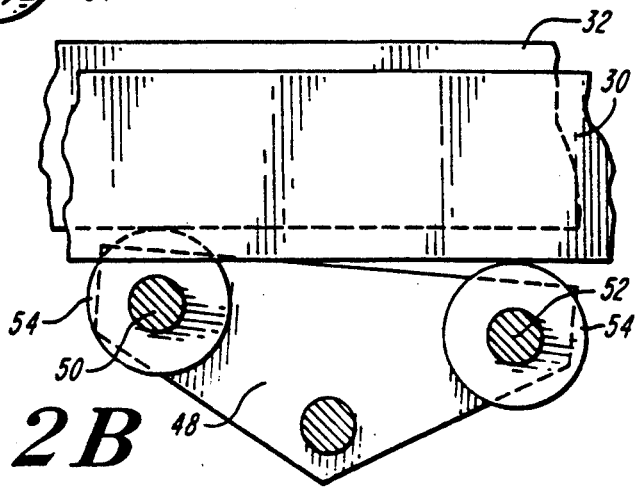

As depicted in FIGS. 2A and 2B, the bogies 48 may be inclined, tilted, or rotated to raise one beam while lowering the other beam. FIG. 2A depicts the rotation of one the bogies 48 necessary to raise the inner beam 30 and lower the outer beam 32 with respect to each other. FIG. 2B illustrates the bogie rotation necessary to raise the outer beam 32 and lower the inner beam 30 with respect to each other.

Figure 3A:
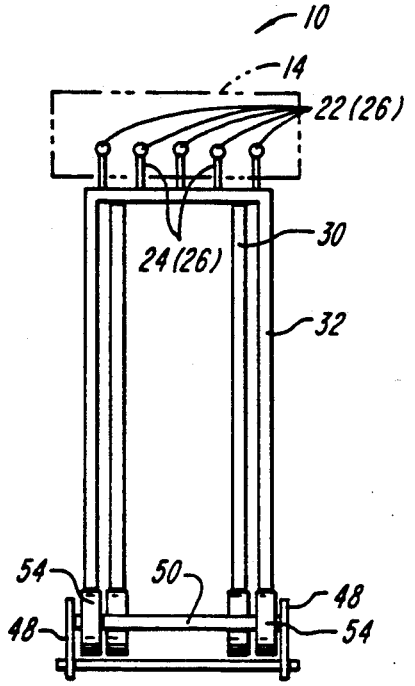
FIG. 3A is an end view of the device of FIG. 1, taken along the line A—A, with the bogies in a level position.
Figure 3B:
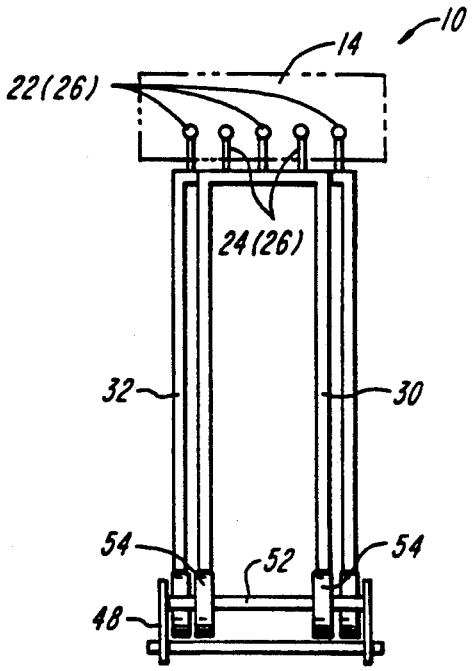
FIG. 3B is an end view of the device of FIG. 1, taken along the line B—B, with the bogies in a level position.

Referring to FIGS. 3A and 3B, wherein FIG. 3A is an end view of the walking hearth furnace 10 along the line A—A, and FIG. 3B is an end view of the invention along the line B—B, the positioning of the beams 30 and 32, and the spacing of the wheels 54 on the axles 50 and 52 are more clearly illustrated. One axle 50 of each bogie 48 has its wheels 54 spaced on the axle 50 a distance corresponding to the spacing of the central bodies 36 of the outer beam 32, and the other axle 52 of each bogie 48 has its wheels 54 spaced apart a distance corresponding to the spacing of the central bodies 36 of the inner beam 30. Both FIGS. 3A and 3B depict the bogies 48 in a non-tilted position that keeps both the inner beam 30 and the outer beam 32 level with respect to each other, and therefore the two groups of rods 22 and 24 form a single level hearth 26.

Figure 3C:
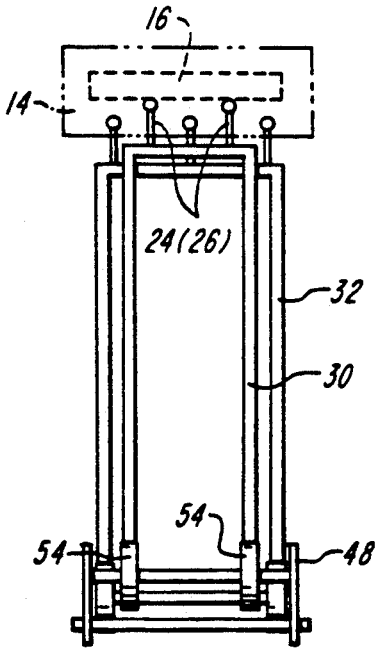
FIG. 3C is an end view of the device of FIG. 1, taken along the line B—B, which illustrates the inner beam in a raised position.
Figure 3D:
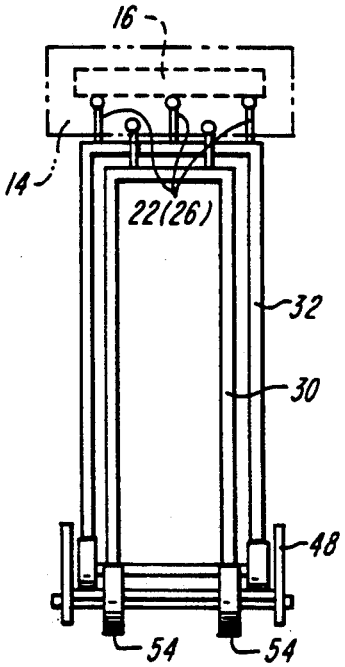
FIG. 3D is an end view of the device of FIG. 1, taken along the line B—B, which illustrates the outer beam in a raised position.

FIGS. 3C and 3D illustrate the results of tilting the bogies 48 in unison. FIG. 3C is an end view of the walking hearth furnace 10 taken along the line B—B of FIG. 1 when the bogies 48 are tilted to raise the inner beam 30 with respect to the outer beam 32, thereby forming the hearth 26 to support the work product 16 with the second group of rods 24. FIG. 3D is an end view of the walking hearth furnace 10 taken along the line B—B of FIG. 1 when the bogies 48 are tilted in the opposite sense to raise the outer beam 32 with respect to the inner beam 30, thereby forming the hearth 26 with the first group of rods 22.

Figure 4:
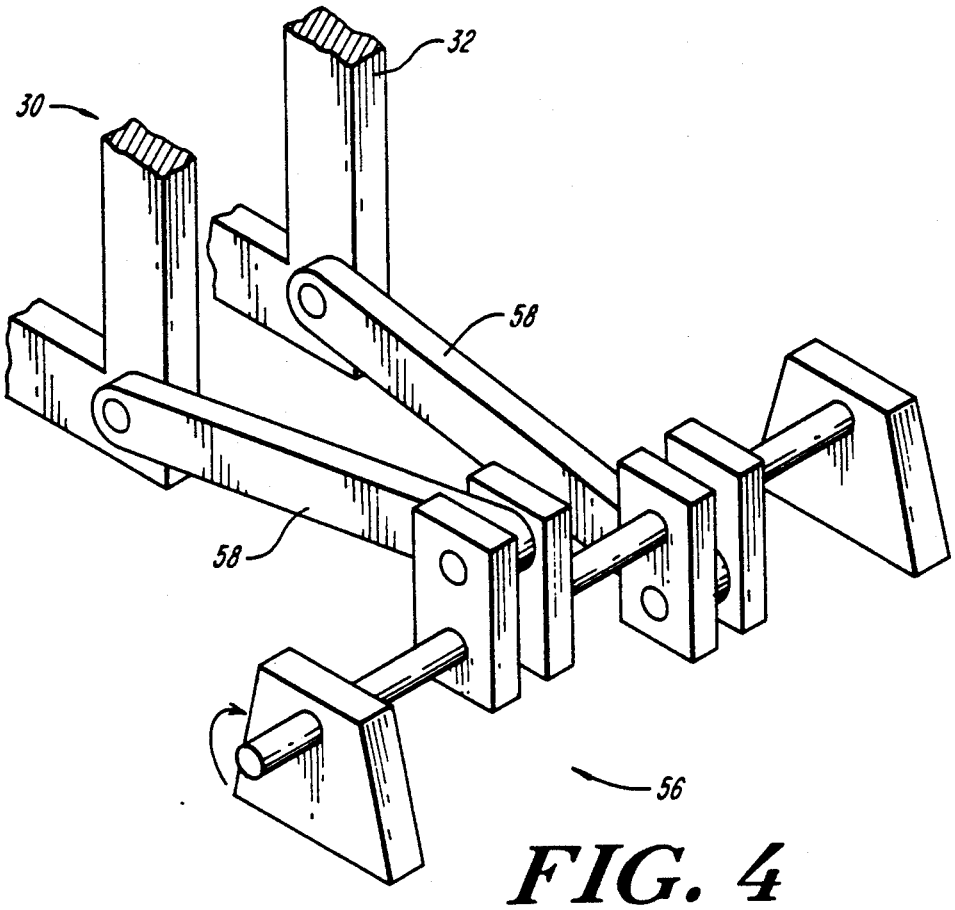
FIG. 4 is a perspective view of a first crankshaft coupled to the device of FIG. 1, for producing coordinated horizontal beam motion.
Figure 5:
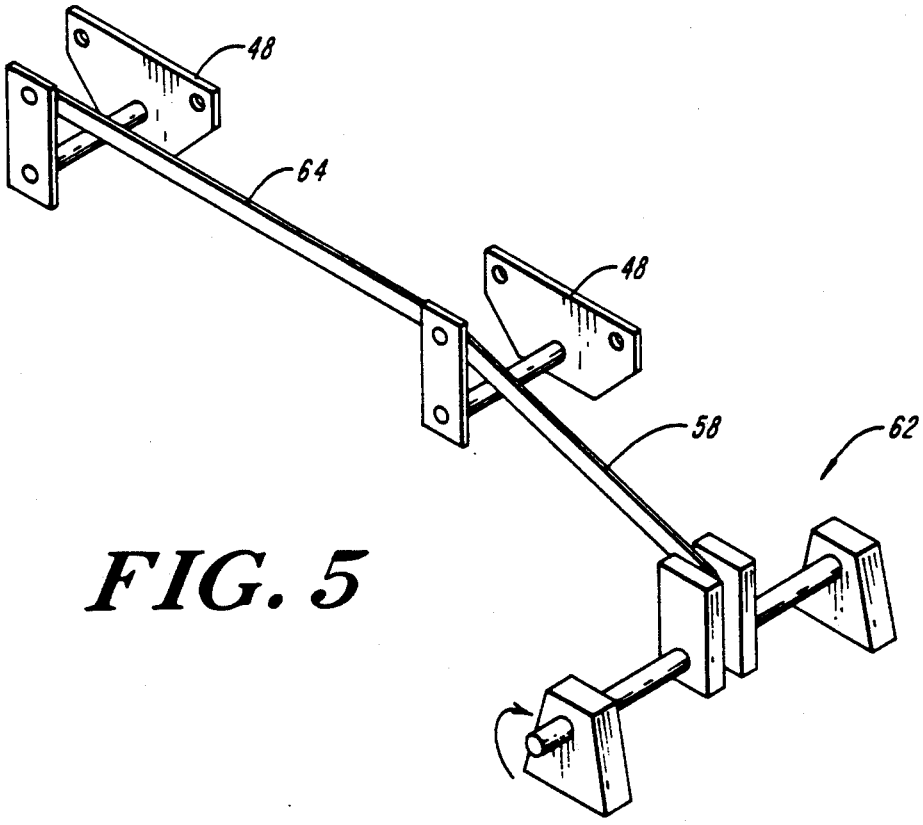
FIG. 5 is a perspective view of a second crankshaft coupled to the device of FIG. 1, for coordinating vertical beam motion.
Figure 6:
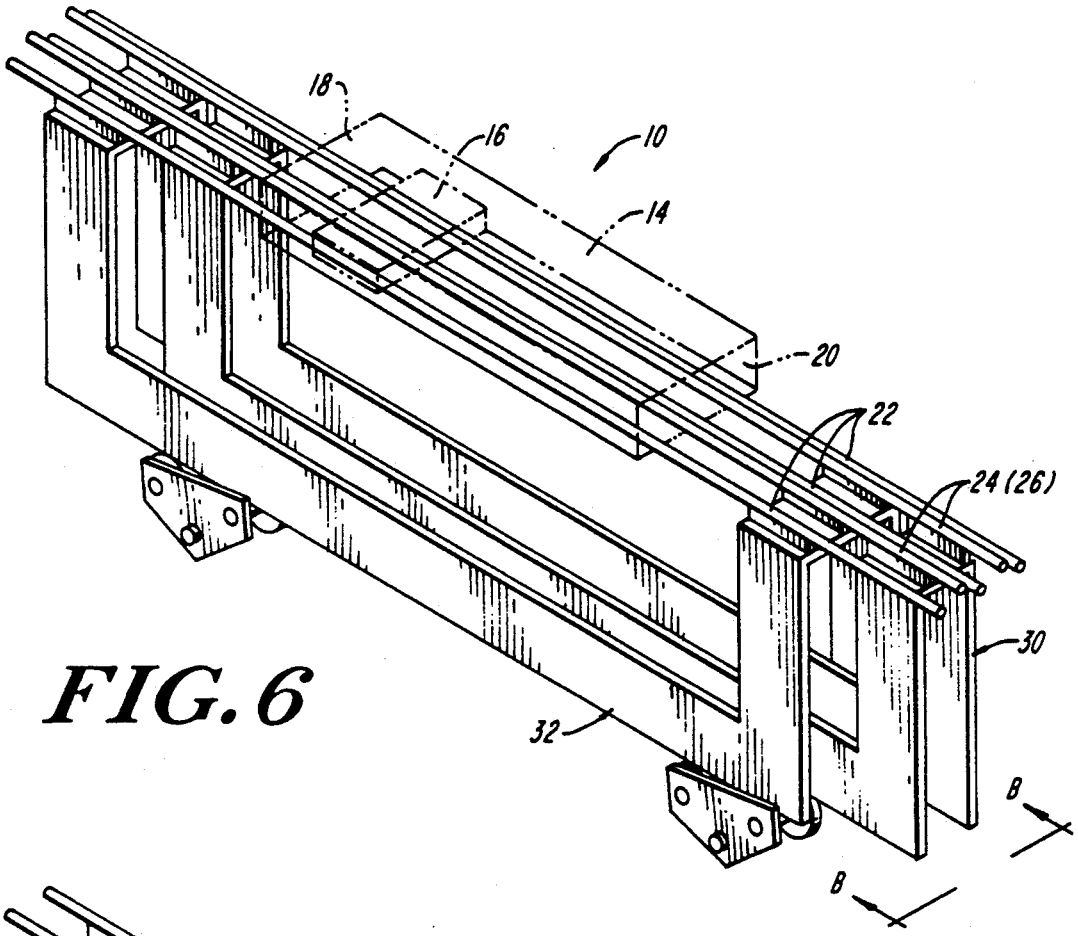
FIGS. 6, 7, 8, and 9 are a series of perspective views of the device of FIG. 1, depicting a sequence of beam and bogie movements for transporting a work product through a furnace muffle.

In addition to moving vertically with respect to each other, the beams 30, 32 with attached rods 12 must also move horizontally in order to advance the work product 16 through the muffle 14. One way to produce reciprocating horizontal motion is with a horizontal displacement device such as a crankshaft. FIG. 4 depicts an exemplary first crankshaft 56 coupled to the inner and outer beams 30 and 3 with links 58. As the first crankshaft 56 rotates in the direction indicated by the arrow, the links 58 and the beams 30, 32 move back and forth in a reciprocating manner. In a similar fashion, an exemplary second crankshaft 62, shown in FIG. 5 coupled to the bogies 48 with a link 58, can be used to tilt the bogies 48 back-and-forth in unison. The bogies 48 are shown coupled with a rod 64, so that movement of the link 58, produced by rotation of the second crankshaft 62 in the direction indicated by the arrow, causes each of the bogies 48 to tilt in unison. With respect to both the first and second crankshafts 56 and 62, the amount of beam or bogie motion is related to the throw-length of the crankshafts, whereby a large throw produces a greater movement than a small throw. Crankshafts and linkages are well know to those skilled in the art, therefore, many variations on the crankshaft and linkage configurations illustrated in the exemplary embodiment are possible.

Figure 7:
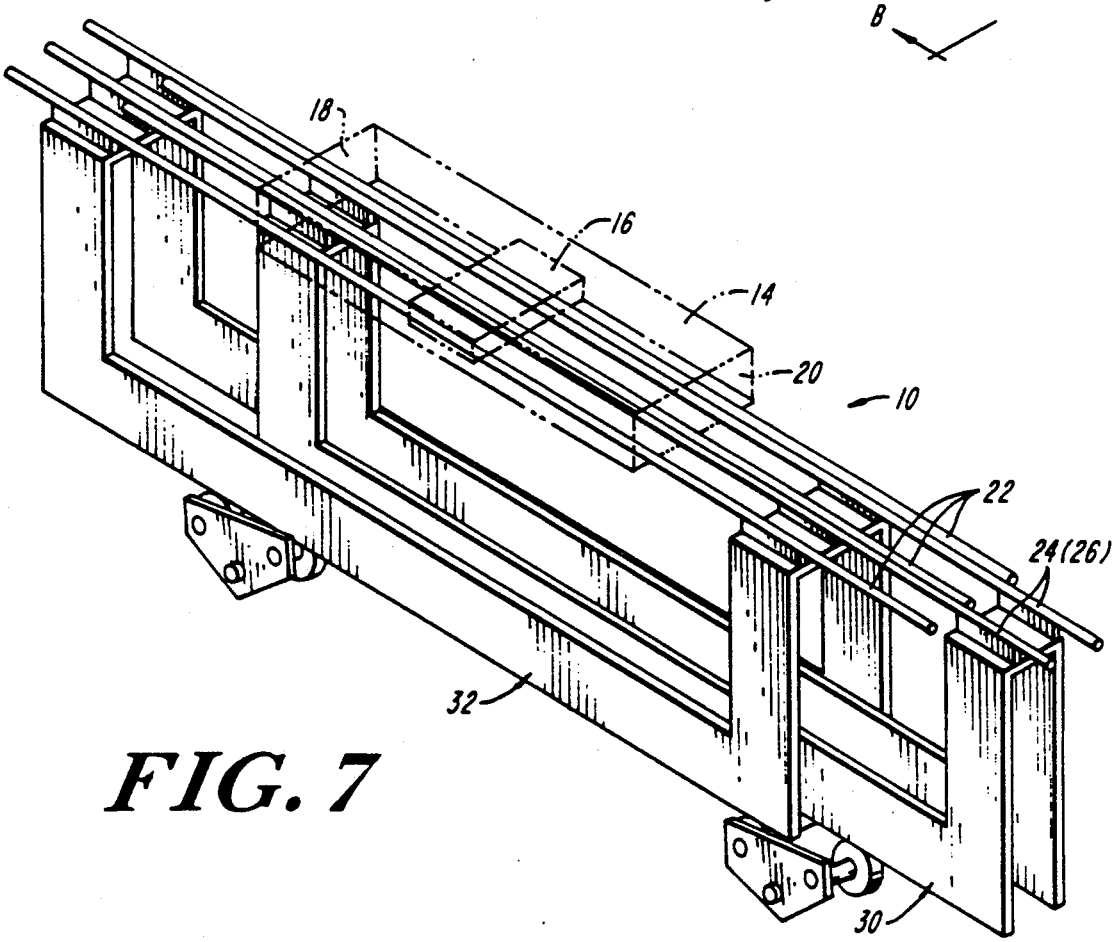
Figure 8:
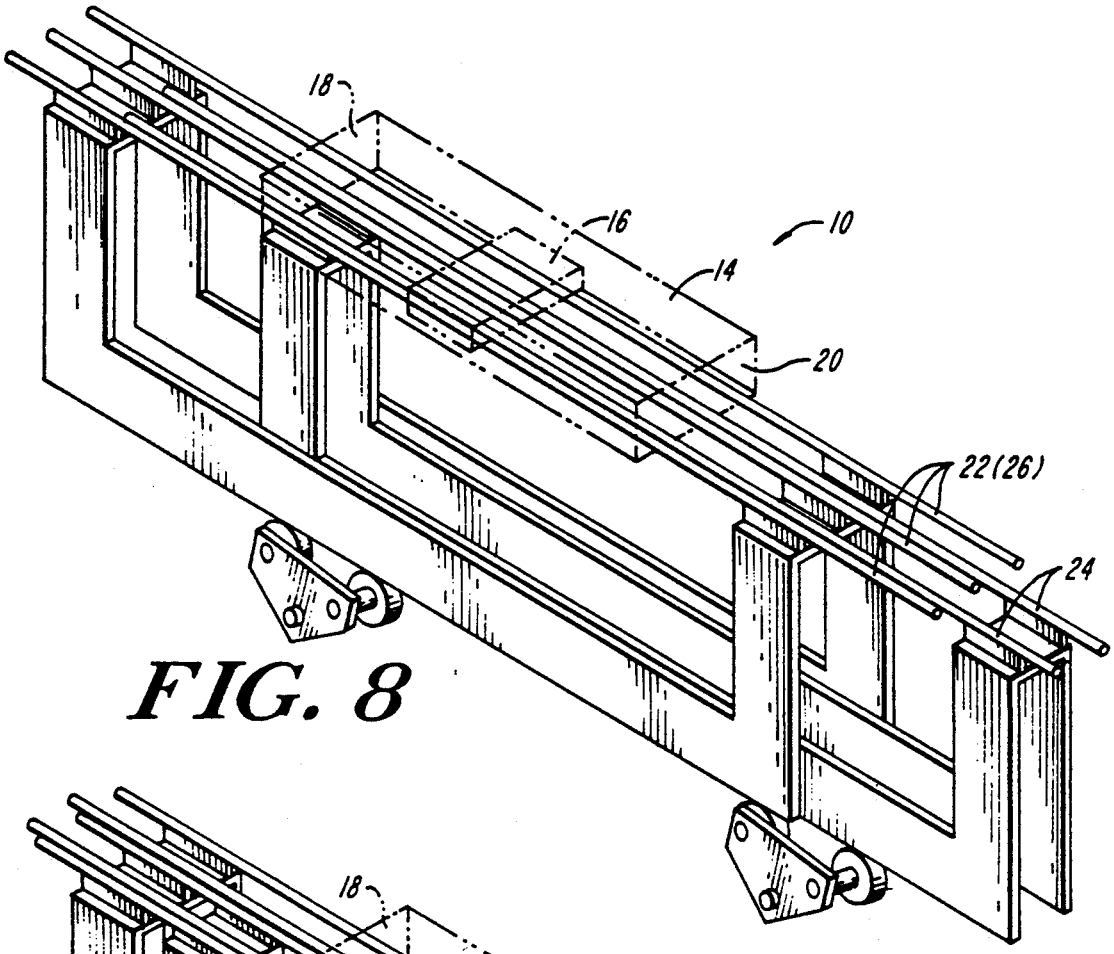
Figure 9:
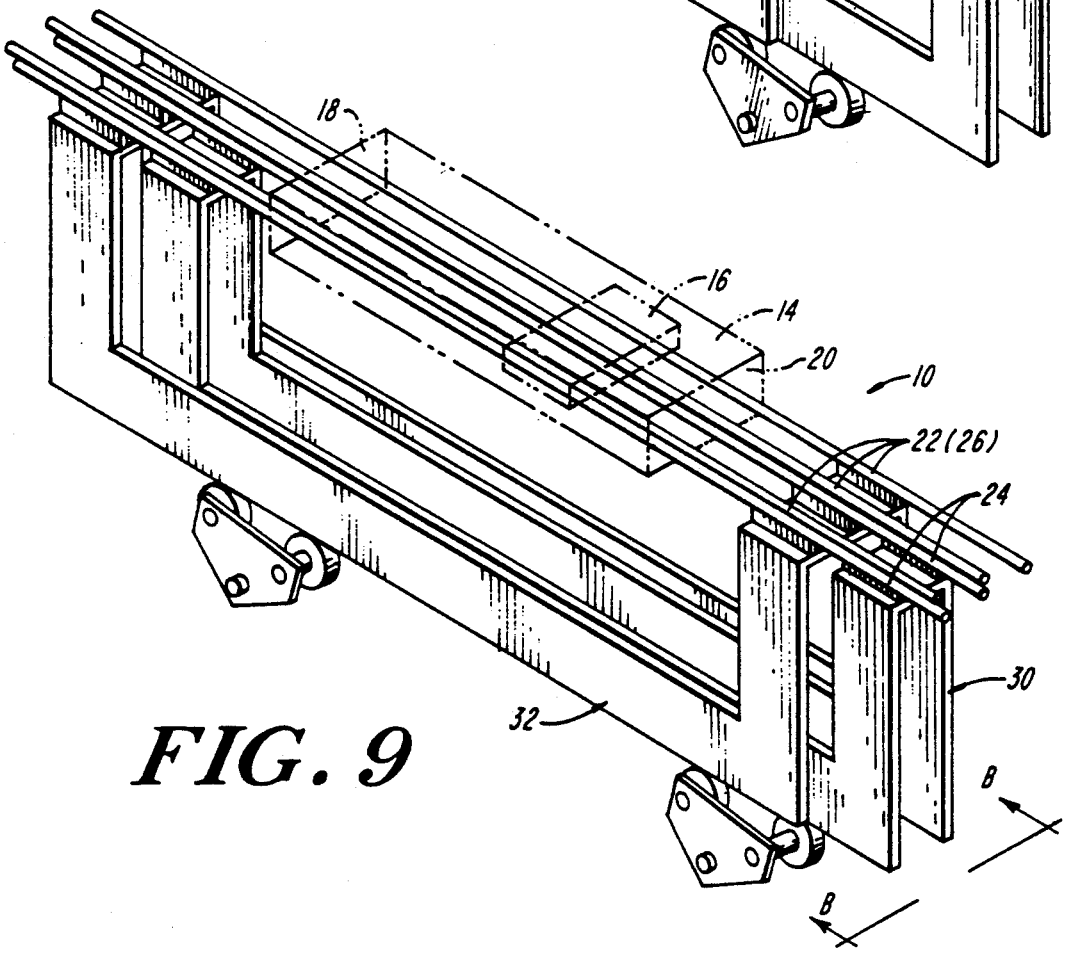

FIGS. 6, 7, 8, and 9 illustrate the walking beam furnace 10 in a series of positions which correspond to stages in a cycle of movements to transport the work product 16 through the furnace muffle 14. Conveyance of the work product 16 is brought about by a coordinated cycle of vertical and horizontal movements of the inner and outer beams 30 and 32 and the corresponding first and second groups of rods 22 and 24. An exemplary sequence of steps or motions is as follows: the first group of rods 22 is lowered while the second group 24 is raised (FIG. 6); and the second group 24 is horizontally translated along the longitudinal axis of the muffle 14 toward the exit aperture 20 concurrent with the first group 22 being horizontally translated along the longitudinal axis of the muffle 14 toward the entry aperture 18 a similar distance (FIG. 7). The cycle is completed when the first and second groups 22 and 24 reciprocally exchange the lowered and raised positions (FIG. 8) and the advanced and retracted positions (FIG. 9) to move the work product 16 another increment toward the exit aperture 20. Repetition of this cycle advances the work product 16 through the muffle 14 in an incremental manner. In an exemplary embodiment, the work product 16 advances in two to three inch increments. Additionally, this method of conveyance is easier to automate than a conveyor type device and is compatible with automation systems known in the art for use with other walking beam systems.

While the bogies 48 and crankshafts 56, 62 are an elegant solution to the problem of incrementally advancing the work product 16 with the alternating hearth 26, other mechanisms are compatible with the concept of the invention. Horizontally movable hydraulic, pneumatic, or mechanical lifters may be used to alternately raise, lower, advance, and retract the beams 30, 32, or the if beams are not used, the rods 12 themselves. In a similar manner, the first crankshaft 56 can be replaced with individual actuators for advancing and retracting the beams 30, 32 or rods 12; and the second crankshaft 62 can be replaced with individual actuators for tilting the bogies 48.

In addition to the significant reduction in particle generation achieved by moving a work product 16 in the above described manner, thermal efficiency and responsiveness are improved by not having the work product conveyance mechanism or hearth 26 travel with the work product 16 through the muffle 14. For example, a furnace using a conveyor belt has a thermal mass (the conveyor belt), and as this mass moves through the furnace it tends to retard thermal changes required by the process. In contrast, the stabilizing or flattening of thermal changes is greatly reduced in the walking hearth furnace 10 because discrete portions of each rod 12 remain in their own thermal zone with little overlap between zones. Because none of the rods 12 travel through the muffle 14 for more than a few inches, a more exacting thermal profile can be achieved. This also makes for a more thermally efficient design because no conveyance components are thermally cycled.

The compact profile of the rods 12 allows a desired furnace atmosphere to be maintained through the use of curtains and gas barriers; and thermal controls, such as the heat barrier and other conventional muffle furnace tactics, to be used with this design,. Furthermore, the rods 12 also offer a low profile hearth allowance that puts the muffle 14 in close range to the work product 16, and it permits easy viewing of the work product 16 from almost any angle. Finally, the open nature of the drive components also facilitates maintenance operations and cleaning.

Although the invention has been shown and described with respect to exemplary embodiments thereof, various other changes, omissions and additions in form and detail thereof may be made therein without departing from the spirit and scope of the invention.

I claim:

1. A walking hearth furnace comprising:

a furnace muffle defining a chamber for containing heat generated by a heat source, said furnace muffle including an entrance aperture and an exit aperture;

a first and a second support surface that transverse but do not contact interior surfaces of said furnace muffle for supporting a work product to be heated therein extending through said chamber, each said support surface having a first end portion protruding from said entrance aperture and a second end portion protruding from said exit aperture;

a first movable support structure engaging only said first and said second end portion of said first support surface;

a second movable support structure engaging only said first and said second end portion of said second support surface; and a movement mechanism engaging said first and said second movable support structure to reciprocally move said first movable support structure with respect to said second movable support structure.

2. A walking hearth furnace comprising: 'a furnace muffle defining a chamber for containing heat generated by a heat source, said furnace muffle including an entrance aperture and an exit aperture;

a first and a second support surface extending through said chamber, each said support surface having a first end portion protruding from said entrance aperture and a second end portion protruding from said exit aperture;

a first movable support structure engaging only said first and said second end portion of said first support surface;

a second movable support structure engaging only said first and said second end portion of said second support surface; and said first and said second support surface alternately advancing said work product from said entrance aperture toward said exit aperture in a linear manner without sliding said work product along either said first or said second support surface.

3. The furnace of claim 2, wherein said chamber includes a floor without an opening therethrough.

4. The furnace of claim 2, wherein said heat source is an explosive gas.

5. The furnace of claim 4, wherein said explosive gas is hydrogen.

6. The furnace of claim 2, wherein said furnace muffle is metallic.

7. The furnace of claim 2, wherein each said support surface includes a plurality rods in parallel disposition, said plurality of rods of said first support surface interleaved with said plurality of rods of said second support surface, each said rod having a high tensile pre-load.

8. The furnace of claim 7, wherein said interleaving of said first and second plurality of rods defines spaced between adjacent rods to permit a heated gas to circulate therebetween and to prevent adjacent rods from touching each other.

9. The furnace of claim 2, wherein said first and second movable support structures move reciprocally in relation to each other and and said first and second end portion of said first and said second support surface remain outside of said chamber of said furnace muffle.

10. A walking hearth furnace comprising:

a furnace muffle defining a chamber for containing heat generated by a heat source, said furnace muffle including an entrance aperture and an exit aperture;

a first plurality of rods for supporting a work product, said first plurality of rods at least coextensive with said furnace muffle, a portion of said rods located within said chamber, said rods supported by a first support structure comprising an inner beam having two side members connected at a first end by a first inner rod mounting platform and at a second end by a second inner rod mounting platform;

a second plurality of rods for supporting a work product, said second plurality of rods at least coextensive with said furnace muffle, interleaved with said first plurality of rods, supported by a second support structure comprising an outer beam having two side members connected at a first end by a first outer rod mounting platform and at a second end by a second outer rod mounting platform, and a portion of said rods located within said chamber;

a vertical displacement device for alternately isolating said first and said second plurality of rods to form a hearth for said work product positioned thereon, by raising and lowering said first and said second plurality of rods with respect to each other, wherein each said plurality of rods moves in unison; and a horizontal displacement device for advancing in unison, either said first or said second plurality of rods comprising said hearth, from said entrance aperture toward said exit aperture, thereby translating said work product positioned thereon in a rectilinear manner.

11. The furnace of claim 10, wherein said vertical displacement device comprises a first and a second bogie, each said bogie comprising a first and a second axle, each said first axle comprising a first and a second wheel, each said first and second wheel supporting one of said side members of said outer beam, each said second axle comprising a third and a fourth wheel, each said third and fourth wheel supporting one of said side members of said inner beam, wherein inclining said first and said second bogies to lower each said first axle, raises each said second axle, thereby raising said inner beam and said first plurality of rods attached thereto with respect to said outer beam and said second plurality of rods, thereby forming a hearth, and wherein inclining said first and said second bogies to lower each said second axle, raises each said first axle, thereby raising said outer beam and said second plurality of rods attached thereto with respect to said inner beam and said first plurality of rods thereby replacing said first plurality of rods as said hearth.

12. The furnace of claim 10, wherein said inner and said outer beams are evenly balanced on said first and said second bogies.

13. The furnace of claim 11, wherein said horizontal displacement device comprises a first crankshaft coupled to said inner beam and said outer beam, wherein rotation of said first crankshaft causes reciprocal, horizontal motion of said inner beam and said outer beam with respect to each other, for advancing either said first or said second plurality of rods comprising said hearth from said entrance aperture toward said exit aperture an increment corresponding to a throw length of said first crankshaft while simultaneously retracting either said first or said second plurality of rods ion a lowered position, thereby translating said work product positioned on said hearth in a rectilinear manner.

14. The furnace of claim 11, wherein a substantial portion of said side members of said inner beam are slidably disposed within an area bounded by said side members of said outer beam.

15. The furnace of claim 11, wherein said first bogie and said second bogie are coupled to a second crankshaft, wherein rotation of said second crankshaft causes said bogies to tilt back-and-forth.

16. The furnace of claim 15, wherein said first bogie is coupled to said second bogie with a rod for ensuring that said bogies tilt in unison.

17. A walking hearth furnace comprising:

a heat source;

a furnace muffle defining a chamber for containing heat generated by said heat source, said furnace muffle including an entrance aperture and an exit aperture;

a first plurality of rods for supporting a work product, said first plurality of rods at least coextensive with said furnace muffle, a portion of said rods located within said chamber, said rods supported by an inner beam having two side members joined at a first end by a first inner rod mounting platform anchoring a first end portion of each rod of said first plurality of rods and joined at a second end by a second inner rod mounting platform anchoring a second end portion of each rod of said first plurality of rods;

a second plurality of rods for supporting a work product, said second plurality of rods at least coextensive with said furnace muffle, interleaved with said first plurality of rods, supported by an outer beam, and a portion of said rods located within said chamber, said outer beam having two side members joined at a first end by a first outer rod mounting platform anchoring a first end portion of said second plurality of rods and joined at a second end by a second outer rod mounting platform anchoring a second end portion of said second plurality of rods;

a first and a second bogie, each said bogie comprising a first and a second axle, each said first axle comprising a first and a second wheel, each said first and second wheel supporting a side member of said outer beam, each said second axle comprising a third and a fourth wheel, each said third and fourth wheel supporting a side member of said inner beam, wherein inclining said first and said second bogies to lower each said first axle, raises each said second axle, thereby raising said inner beam and said first plurality of rods attached thereto with respect to said outer beam and said second plurality of rods, thereby forming a hearth, and wherein inclining said first and said second bogies to lower each said second axle, raises each said first axle, thereby raising said outer beam and said second plurality of rods attached thereto with respect to said inner beam and said first plurality of rods thereby replacing said first plurality of rods as said hearth;

a first crankshaft coupled to said inner beam and said outer beam, wherein rotation of said first crankshaft causes reciprocal, horizontal motion of said inner beam and said outer beam with respect to each other, for advancing either said first or said second plurality of rods comprising said hearth from said entrance aperture toward said exit aperture an increment corresponding to a throw length of said first crankshaft while simultaneously retracting either said first or said second plurality of rods in a lowered position, thereby translating said work product positioned on said hearth in a rectilinear manner; and a second crankshaft coupled to said first and said second bogies, wherein rotation of said second crankshaft causes said bogies to tilt back-and-forth in unison.

* * * * *

UNITED STATES PATENT AND TRADEMARK OFFICE

CERTIFICATE OF CORRECTION

PATENT NO. : 5,314,330

DATED : May 24, 1994

INVENTOR(S) : Gary A. Orbeck

It is certified that error appears in the above-indentified patent and that said Letters Patent is hereby corrected as shown below:

Column 5, line 48, "beams 30 and 3" should read --beams 30 and 32--.

Column 6, line 62, "design,." should read --design.--.

Column 7, line 12, "transverse" should read --traverse--.

Column 7, line 63, "spaced" should read --spaces--.

Column 9, line 5, "rods ion a" should read --rods in a --.

Signed and Sealed this

Twentieth Day of December, 1994

*Attest:*

Bruce Lehman

BRUCE LEHMAN

*Attesting Officer*

*Commissioner of Patents and Trademarks*